US011833841B2

(12) United States Patent
Arita et al.

(10) Patent No.: US 11,833,841 B2
(45) Date of Patent: Dec. 5, 2023

(54) PRINTING APPARATUS AND CONTROL METHOD

(71) Applicant: CANON KABUSHIKI KAISHA, Tokyo (JP)

(72) Inventors: Keisuke Arita, Kanagawa (JP); Sho Takahashi, Kanagawa (JP); Toshiaki Tokisawa, Kanagawa (JP); Soma Nakai, Tokyo (JP); Yuka Tani, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 45 days.

(21) Appl. No.: 17/690,113

(22) Filed: Mar. 9, 2022

(65) Prior Publication Data

US 2022/0305825 A1 Sep. 29, 2022

(30) Foreign Application Priority Data

Mar. 26, 2021 (JP) ..... 2021-053236

(51) Int. Cl.
*B41J 3/407* (2006.01)
*B41J 25/308* (2006.01)

(52) U.S. Cl.
CPC ..... *B41J 25/308* (2013.01); *B41J 3/4073* (2013.01)

(58) Field of Classification Search
CPC ..... B41J 3/4073; B41J 25/308; B41J 11/005
See application file for complete search history.

(56) References Cited

U.S. PATENT DOCUMENTS 5,316,395 A * 5/1994 Imai ..... B41J 3/283 400/58
2016/0167396 A1* 6/2016 Chang ..... B41J 3/4073 347/37
2017/0225494 A1* 8/2017 Tokunaga ..... B41J 11/006
2019/0299683 A1* 10/2019 Takakusa ..... B41J 19/14
2021/0300033 A1* 9/2021 Kondo ..... B41J 2/04551

FOREIGN PATENT DOCUMENTS

JP 2017-018588 A 1/2017

OTHER PUBLICATIONS

Soma Nakai, U.S. Appl. No. 17/706,728, filed Mar. 29, 2022.
Yuka Tani, U.S. Appl. No. 17/706,670, filed Mar. 29, 2022.
Naoya Ogawa, U.S. Appl. No. 17/695,887, filed Mar. 16, 2022.

* cited by examiner

*Primary Examiner* — Scott A Richmond
(74) *Attorney, Agent, or Firm* — VENABLE LLP

(57) ABSTRACT

A printing apparatus includes a printing unit to eject a liquid to an object to be printed in a first direction to perform printing, a placement unit on which the object is placed, and a detection unit capable of detecting a position of the object in the first direction in a noncontact manner. A control unit performs a first detection which changes relative positions of the placement unit and the detection unit in the first direction and on a plane intersecting the first direction before the printing on the object to detect, by the detection unit, the object placed on the placement unit, and the control unit performs a second detection which changes the relative positions of the placement unit and the detection unit on the plane during the printing on the object to detect, by the detection unit, the object placed on the placement unit.

20 Claims, 13 Drawing Sheets

PRINTING APPARATUS AND CONTROL METHOD

BACKGROUND OF THE INVENTION

Field of the Invention

The present invention relates to a printing apparatus capable of printing an image and a method of controlling the printing apparatus.

Description of the Related Art

Japanese Patent Laid-Open No. 2017-18588 discloses a technique for detecting the height of a nail in a spring-biased state using a fixedly provided laser sensor comprising a laser light emitting portion and a laser light receiving portion in a nail printing apparatus. Specifically, Japanese Patent Laid-Open No. 2017-18588 discloses detecting whether the height of the nail is equal to or greater than that of a predetermined position.

Incidentally, in a nail printing apparatus, in order to maintain proper print quality, a distance between a printing portion which performs rendering, that is, printing on a nail and the nail to be printed must be adjusted to a distance suitable for printing. However, since there are variations in the shapes of nails and the shapes of fingers among individuals, the relative positions of the printing portion and a nail suitable for printing vary with each individual or finger.

In the technique disclosed in Japanese Patent Laid-Open No. 2017-18588, since a laser sensor is fixedly arranged, there is a possibility that the position in a height direction of a nail suitable for printing, which varies with each individual or finger cannot be properly detected.

SUMMARY OF THE INVENTION

The present invention is made in view of the above problem and provides a technique capable of properly detecting the height position of an object to be printed.

In the first aspect of the present invention, there is provided a printing apparatus including:

a printing unit configured to eject a liquid to an object to be printed in a first direction to perform printing;

a placement unit on which the object is placed;

a detection unit capable of detecting a position of the object in the first direction in a noncontact manner; and a control unit configured to change relative positions of the placement unit and the detection unit on a plane intersecting the first direction to detect, by the detection unit, the object placed on the placement unit.

In the second aspect of the present invention, there is provided a method of controlling a printing apparatus including:

a printing unit configured to eject a liquid to an object to be printed in a first direction to perform printing; and a placement unit on which the object is placed, the method including:

detecting a position of the object in the first direction in a noncontact manner; and changing relative positions of the placement unit and the detection unit on a plane intersecting the first direction.

According to the present invention, the height position of an object to be printed can be properly detected.

Further features of the present invention will become apparent from the following description of exemplary embodiments with reference to the attached drawings.

DESCRIPTION OF THE EMBODIMENTS

A description will be given in detail of an example of embodiments of a printing apparatus and a method of controlling the printing apparatus with reference to the accompanying drawings. It should be noted that the following embodiments do not limit the present invention, and not all combinations of features described in the embodiments are necessarily essential to a means to solve the problem to be solved by the invention. The relative positions, shapes, and the like of features described in the embodiments are merely examples, and the scope of the present invention is not limited to them. In the following embodiments, a description will be given of a nail printing apparatus for printing a user's nail as an object. However, the object may be something other than a nail, such as a three-dimensional object, and is not specifically limited.

First Embodiment

First, a description will be given of a nail printing apparatus according to a first embodiment with reference to FIG. 1 to FIG. 8.

<Configuration of Nail Printing Apparatus>

Figure 1:
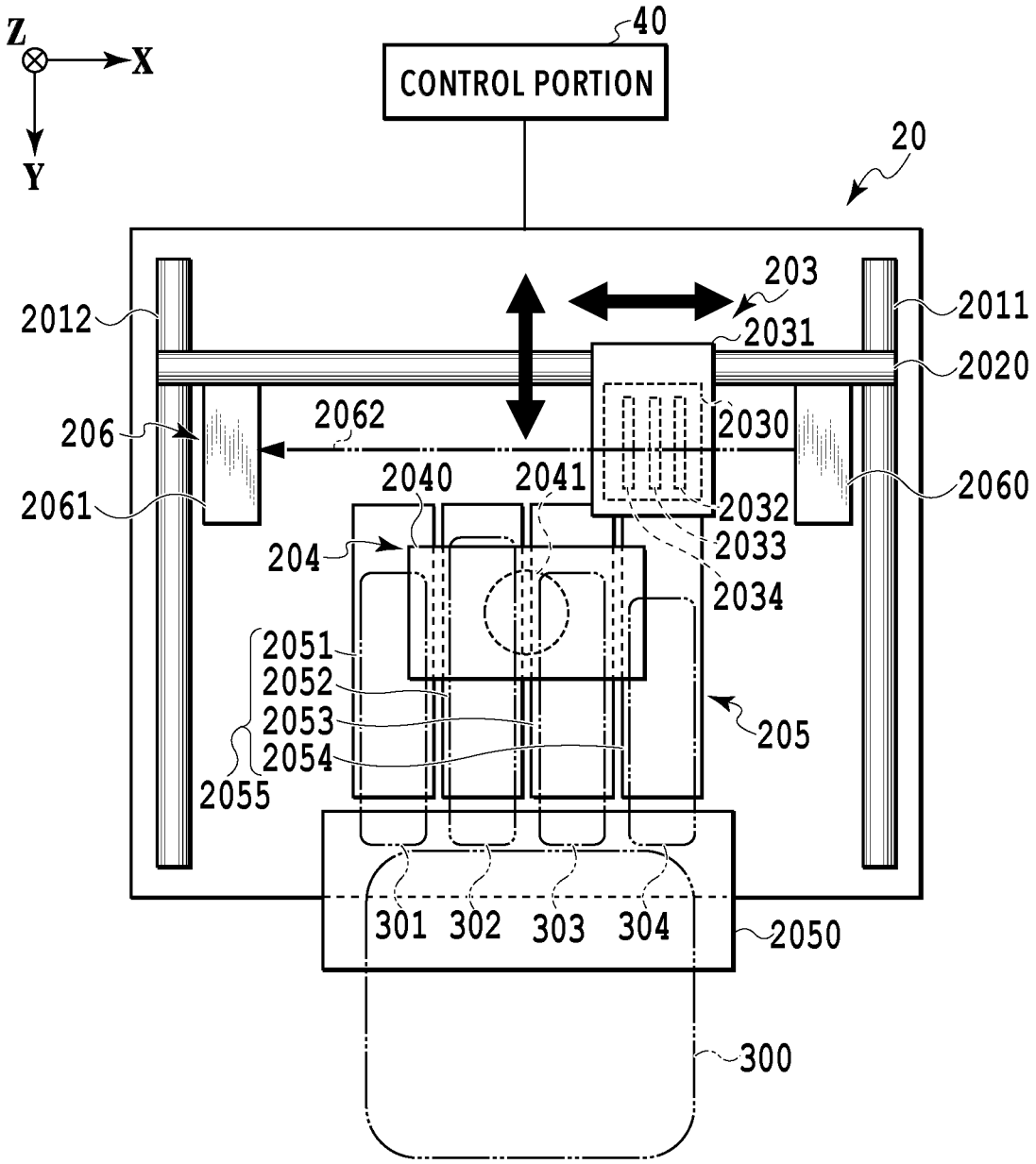
FIG. 1 is a plan view showing a schematic configuration of a nail printing apparatus according to an embodiment.
Figure 2:
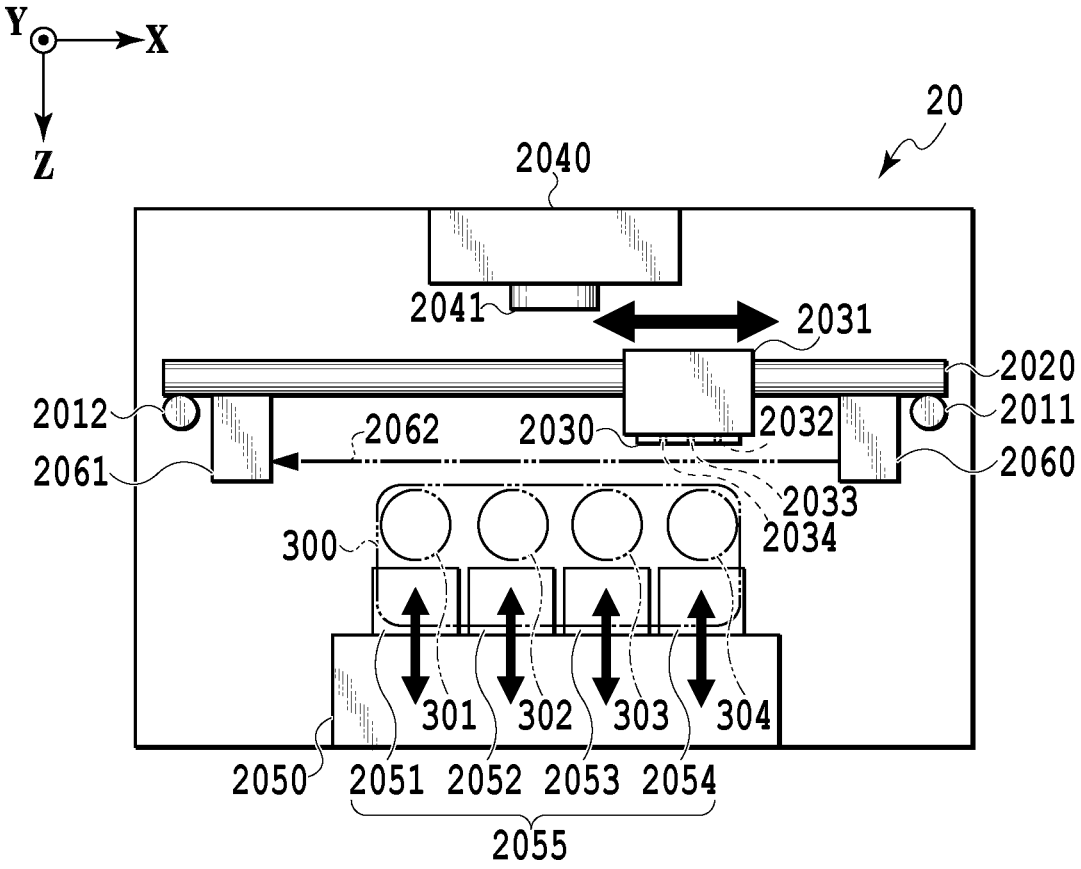
FIG. 2 is a front view of the nail printing apparatus in FIG. 1.
Figure 3:
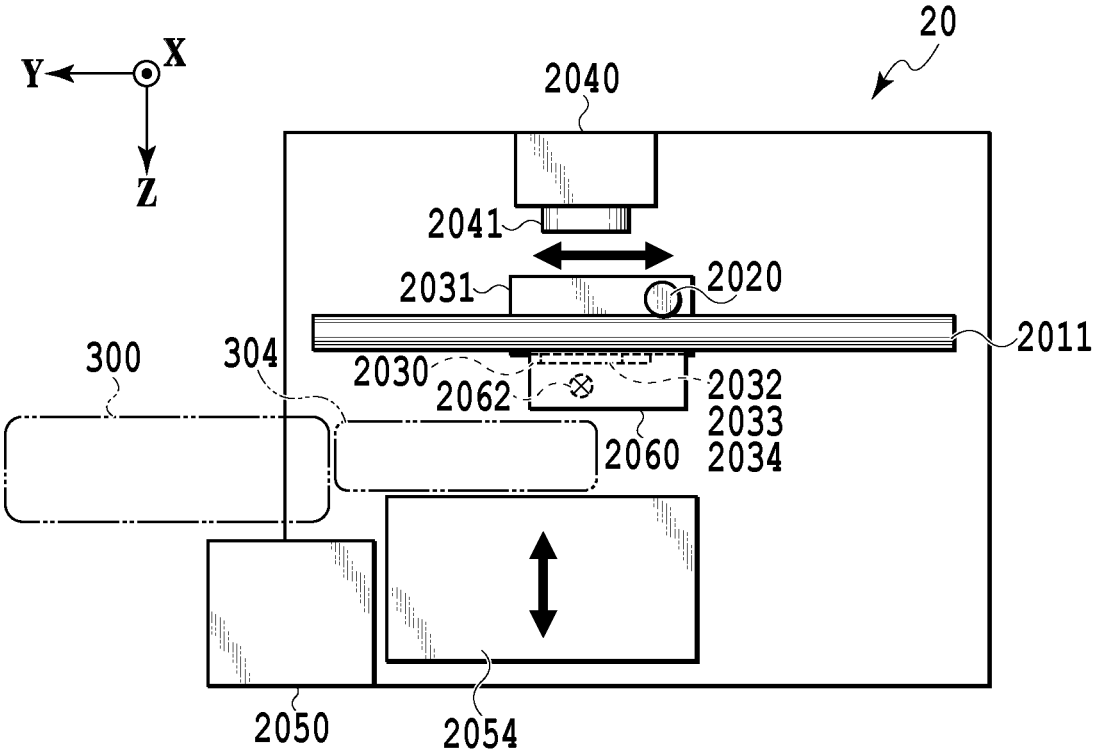
FIG. 3 is a right side view of the nail printing apparatus in FIG. 1.

FIG. 1 is a plan view showing a schematic configuration of the nail printing apparatus of the embodiment. FIG. 2 is a front view of the nail printing apparatus in FIG. 1. FIG. 3 is a right side view of the nail printing apparatus in FIG. 1. A nail printing apparatus 20 according to the embodiment includes a printing portion 203 configured to eject, based on an inkjet system, ink as a liquid to a nail (also referred to as a "nail portion" as appropriate in the present specification) as an object to be printed. The nail printing apparatus 20 also includes a hand placement portion 205 on which a finger (hand) of a nail to be printed can be placed. The relative positions of the printing portion 203 and the hand placement portion 205 can be changed in an X direction and a Y direction intersecting (orthogonal to in the present embodiment) the X direction.

The nail printing apparatus 20 includes a photographing portion 204 for acquiring the position and shape in an XY direction of the nail on the finger placed on the hand placement portion 205. The nail printing apparatus 20 also includes a laser portion 206 for detecting the position of the nail on the finger placed on the hand placement portion 205 in a Z direction intersecting (orthogonal to in the present embodiment) the X direction and the Y direction. The Z direction in the present embodiment is a direction in which a liquid is ejected from the printing portion 203 to the nail portion as an object to be printed.

<Printing Portion>

The printing portion 203 includes a carriage 2031 movable in the X direction and a print head 2030 which is detachably attachable to the carriage 2031. In the print head 2030, a nozzle row 2032 for ejecting cyan (C) ink, a nozzle row 2033 for ejecting magenta (M) ink, and a nozzle row 2034 for ejecting yellow (Y) ink are formed. Each of these nozzle rows is formed by arranging a plurality of nozzles for ejecting corresponding ink along the Y direction. In a case where the print head 2030 is mounted on the carriage 2031, the nozzle rows are arranged in the order of the nozzle row 2032, the nozzle row 2033, and the nozzle row 2034 in a —X direction. To the print head 2030, ink is supplied from an ink tank (not shown) mounted on the nail printing apparatus 20, and the supplied ink is ejected from a nozzle of a corresponding nozzle row. Each nozzle row is formed on the same plane. The color of the ink ejected from the print head 2030 is an example and is not limited thereto.

The carriage 2031 is provided movably in the XY direction with respect to the hand placement portion 205. Thus, the print head 2030 mounted on the carriage 2031 is provided movably, by the carriage 2031, in the XY direction with respect to the hand placement portion 205. More specifically, in the present embodiment, the carriage 2031 is provided movably on an X rail guide 2020 extending in the X direction. The X rail guide 2020 is movably provided on a pair of Y rail guides 2011 and 2012 extending in the Y direction. The carriage 2031 can be reciprocated in a +X direction and the —X direction along the X rail guide 2020 by a motor (not shown). The X rail guide 2020 can also be reciprocated in a +Y direction and a —Y direction along a pair of Y rail guides 2011 and 2012 by a motor (not shown). In the present embodiment, the X rail guide 2020 and the Y rail guides 2011 and 2012 function as a guide portion that movably guides the printing portion 203 and the like in a corresponding direction.

The movable range of the carriage 2031 in the X direction is, for example, at least a range in which a fingernail placed on the hand placement portion 205 in a print preparation position (described later) can be printed. Further, the movable range of the carriage 2031 in the Y direction includes, for example, a position where the fingernail placed on the hand placement portion 205 in the print preparation position can be printed and a position which does not overlap with the hand placement portion 205 in the print preparation position in the Y direction.

As described above, in the present embodiment, the carriage 2031 (print head 2030) is movable in the X direction and the Y direction with respect to the hand placement portion 205, but the present invention is not limited to this. That is, the relative positions of the printing portion 203 and it is only required that the hand placement portion 205 can be changed in the X direction and the Y direction, and the moving mechanism of the printing portion 203 with respect to the hand placement portion 205 is not limited to the configuration described above. For example, the hand placement portion 205 may be movable in the Y direction with respect to the printing portion 203 and the laser portion 206.

In the case of printing on a nail to be printed, a print operation in which ink is ejected to the nail while moving the print head 2030 in the X direction to print an image for one scan is performed on the nail. Then, after a movement operation in which the print head 2030 is moved in the Y direction by a predetermined amount corresponding to printing for one scan is performed, the print operation is performed again. In this way, in the nail printing apparatus 20, an image is printed on the nail to be printed by alternately and repeatedly performing the print operation and the movement operation.

<Photographing Portion>

A photographing portion 204 is arranged in a position where the nail on the finger placed on the hand placement portion 205 in the print preparation position can be photographed. In the present embodiment, a camera 2040 is arranged above the hand placement portion 205 in the print preparation position. The camera 2040 is configured to photograph a finger through a photographing lens 2041. In a case where a right hand is placed on the hand placement portion 205, the center of an image photographed with the camera 2040 is, for example, between a middle finger and a ring finger in the X direction, and in a position corresponding to the nail portions of an index finger and the ring finger in the Y direction (see FIG. 2).

<Hand Placement Portion>

The hand placement portion 205 is located below the printing portion 203 and, in the present embodiment, is arranged on the bottom surface of the nail printing apparatus 20. The hand placement portion 205 includes a palm placement portion 2050 for placing a palm and four finger elevating/lowering portions 2051, 2052, 2053, 2054 capable of elevating and lowering a placed finger (movable in the Z direction). In the following description, the finger elevating/lowering portions 2051, 2052, 2053, 2054 will also be collectively referred to as finger elevating/lowering portions 2055. On each finger elevating/lowering portion 2055, one finger having a nail to be printed can be placed. In the present embodiment, the finger elevating/lowering portions 2051 to 2054 on the hand placement portion 205 are movable in the Z direction, but the present invention is not limited to this. That is, it is only required that the relative positions in the Z direction (ink ejection direction) of the finger elevating/lowering portions 2051 to 2054 and the printing portion 203 be changeable, and the moving mechanisms of the finger elevating/lowering portions 2051 to 2054 with respect to the printing portion 203 are not limited to the configuration described above. For example, the printing portion 203 and the laser portion 206 may be movable in the Z direction with respect to the finger elevating/lowering portion 2055. Alternatively, the finger elevating/lowering portion 2055, the printing portion 203, and the laser portion 206 may be movable in the Z direction.

Each of the finger elevating/lowering portions 2051 to 2054 is movable independently in the Z direction by a motor (not shown). In FIGS. 1 to 3, a palm and fingers in a case where the right hand of a subject of printing is placed on the hand placement portion 205 are shown by two-dot chain lines. In FIGS. 1 to 3, an index finger 301 is placed on the finger elevating/lowering portion 2051, a middle finger 302 is placed on the finger elevating/lowering portion 2052, a ring finger 303 is placed on the finger elevating/lowering portion 2053, a little finger 304 is placed on the finger elevating/lowering portion 2054, and a right palm 300 is placed on the palm placement portion 2050.

The hand placement portion 205 is movable between the print preparation position (see FIGS. 1 to 3) where printing can be performed by the printing portion 203 and a hand placement position (not shown) which is out of an area where the printing portion 203 is movable and on which the subject of printing places (sets) a hand. The hand placement position, for example, is located below (downstream in the Y direction of) the illustrated print preparation position in FIG. 1, and is located on the left side (downstream in the Y direction) of the illustrated print preparation position in FIG. 3. In the present embodiment, the finger elevating/lowering portion 2055 functions as a placement portion on which a finger on which a nail portion is formed is placed along the Y direction.

<Laser Portion>

The laser portion 206 includes a light emitting portion 2060 configured to emit laser light as straight light and a light receiving portion 2061 configured to receive the laser light emitted from the light emitting portion 2060. The laser portion 206 is used to detect the position in the Z direction of the nail portion on the finger placed on the finger elevating/lowering portion 2055.

The light emitting portion 2060 and the light receiving portion 2061 are arranged so that an optical axis 2062 of the laser light is located in the lowermost portion of the printing portion 203 (an end on a +Z direction side), that is, below a surface of the print head 2030 on which the nozzle rows 2032 to 2034 are formed. In the present embodiment, a distance in the Z direction between the lowermost portion of the printing portion 203, that is, the surface of the print head 2030 on which the nozzle rows 2032 to 2034 are formed and the optical axis 2062 is equal to or less than a distance suitable for printing on a nail portion to be printed by the printing portion 203. The distance suitable for printing is a distance at which a certain level or higher of print quality can be maintained in a case where ink is ejected from the nozzle rows 2032 to 2034 in the printing portion 203 to the object to be printed to perform printing.

Further, the light emitting portion 2060 and the light receiving portion 2061 are arranged such that a direction intersecting (in the present embodiment, the X direction orthogonal to) a direction (the Y direction) in which the finger elevating/lowering portions 2051 to 2054 extend is parallel to the optical axis 2062. Since the laser portion 206 and the printing portion 203 and the hand placement portion 205 have the above positional relationship, in a case where the finger elevating/lowering portion 2055 is elevated, before the fingers 301 to 304 contact the printing portion 203, these fingers block the optical axis 2062. By using such a configuration, before the fingers 301 to 304 contact the printing portion 203, the laser portion 206 can detect the possibility of the contact. In the present embodiment, the position detected by the laser portion 206 is a position corresponding to the distance suitable for printing of the nail portion formed on the elevated finger.

The laser portion 206 is provided movably in the Y direction with respect to the hand placement portion 205. Specifically, the light emitting portion 2060 and the light receiving portion 2061 are fixedly provided on the X rail guide 2020. The light emitting portion 2060 is fixedly arranged near one end (the right side of FIG. 1) of the X rail guide 2020, and the light receiving portion 2061 is fixedly arranged near the other end (the left side of FIG. 1) of the X rail guide 2020. The arrangement positions of the light emitting portion 2060 and the light receiving portion 2061 in the X rail guide 2020 are out of the movement range of the carriage 2031 provided movably on the X rail guide 2020. As a result, the light emitting portion 2060 and the light receiving portion 2061 are movable in the Y direction by the movement of the X rail guide 2020 in the Y direction via the Y rail guides 2011 and 2012. Additionally, the distance between the optical axis 2062 and the printing portion 203 can be kept to the distance suitable for the printing.

In general, there are variations in the length and shape of a finger and the length and shape of a nail portion among individuals. The same person may have a different length and shape of a nail portion for each finger. The nail portion is not necessarily in a plane shape, and the positions of the nail portions in a height direction may differ depending on the Y direction. A fixedly installed laser cannot properly detect the height position of each nail portion in the Y direction. The laser portion 206 of the present embodiment can move in the Y direction to detect the position of the nail portion. Thus, the height position of the nail portion can be properly detected. It is only required that the relative positions in the Y direction of the laser portion 206 and the hand placement portion 205 be changeable, and the moving mechanism of the laser portion 206 with respect to the hand placement portion 205 is not limited to the configuration described above.

Further, the laser portion 206 is arranged so that the optical axis 2062 overlaps at least three nozzle rows 2032 to 2034 in the X direction and the Y direction. As a result, the optical axis 2062 is located below at least the nozzle rows 2032 to 2034 of the printing portion 203 moving in the X direction. Therefore, regardless of the position of the carriage 2031, the fingers 301 to 304 can be detected by the laser portion 206 before contacting the carriage 2031 and the print head 2030. In the present embodiment, the laser portion 206 is provided between the printing portion 203 and the finger elevating/lowering portion 2055 in the Z direction and functions as a detection portion capable of detecting the position of the nail portion in the Z direction in a noncontact manner.

<Control Portion>

Figure 4:
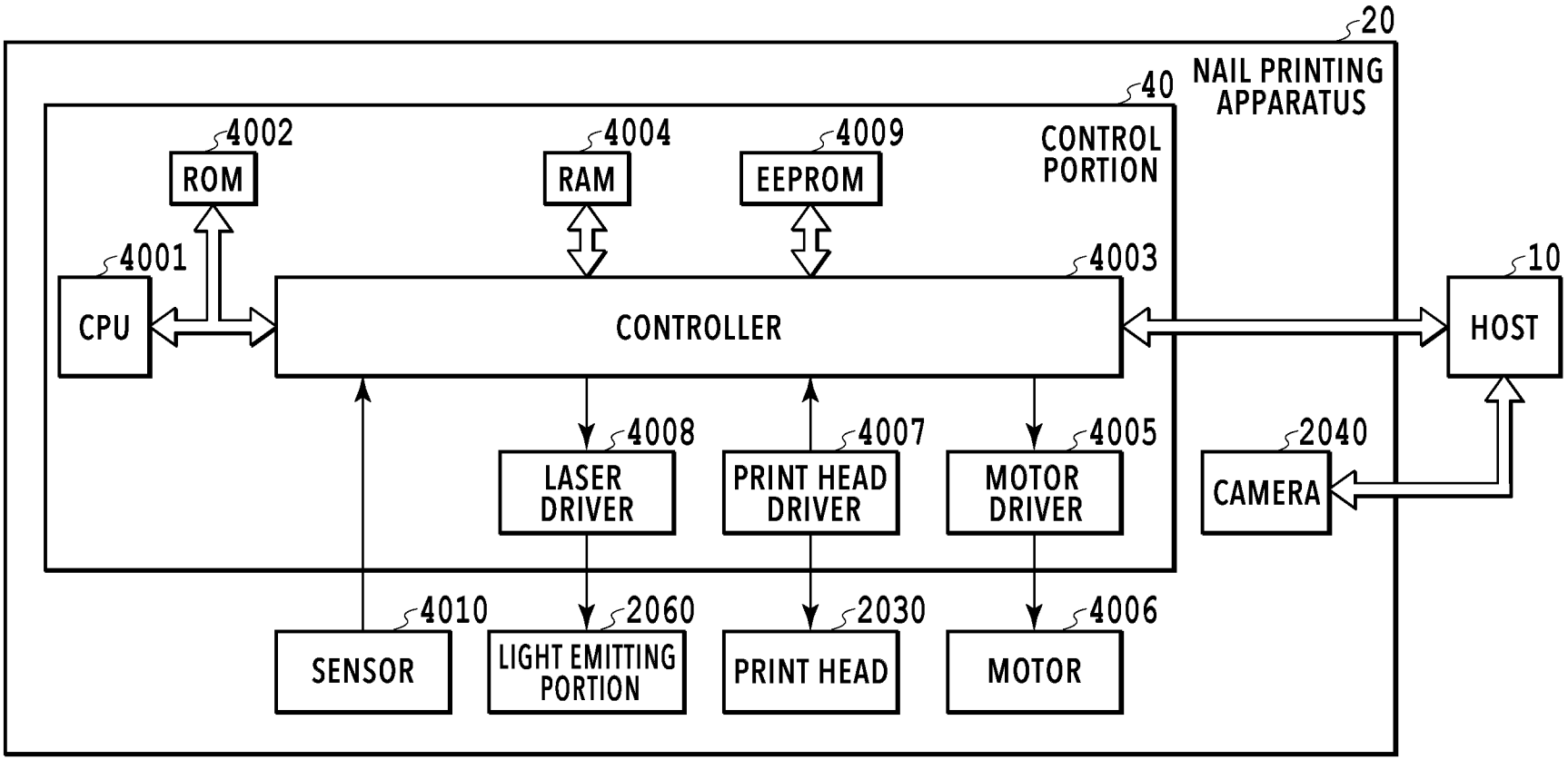
FIG. 4 is a block configuration diagram of a control system of the nail printing apparatus in FIG. 1.

Next, a description will be given of a control portion 40 configured to control the entire operation of the nail printing apparatus 20. FIG. 4 is a block configuration diagram of the control portion. The control portion 40 includes a central processing unit (CPU) 4001. The CPU 4001 controls each feature in the nail printing apparatus 20 via a controller 4003 in accordance with various programs stored in a ROM 4002. At that time, a RAM 4004 is used as a work area for temporarily storing various types of data and executing processing.

The CPU 4001 performs image processing for converting image data received from a host 10 into a print signal which can be printed with the nail printing apparatus 20. As the host 10, for example, a general-purpose personal computer or a mobile terminal such as a tablet can be used, and a user can input various types of information such as image data to the nail printing apparatus 20 via the host 10. Then, the CPU 4001 drives a motor 4006 via a motor driver 4005 based on image-processed information and the like and drives the print head 2030 via a print head driver 4007 to perform printing of a nail to be printed. To facilitate understanding, FIG. 4 shows various motors in the nail printing apparatus 20 by the motor 4006 and shows a motor driver for driving each motor as the motor driver 4005. The CPU 4001 drives the light emitting portion 2060 via the controller 4003 and a laser driver 4008 to emit laser light toward the light receiving portion 2061.

The control portion 40 includes an electrically writable EEPROM 4009. The EEPROM 4009 stores various setting values and data to be updated, and such data is used as a control parameter by the controller 4003 and the CPU 4001. The control portion 40 is connected to a sensor 4010 and performs various types of processing with the CPU 4001 based on information from the sensor 4010. To facilitate understanding, FIG. 4 shows various encoder sensors that detect the moving amounts and the driving amounts of various features and the like, and various sensors including the light receiving portion 2061 as the sensor 4010. The CPU 4001 increments, for example, count information obtained by counting slits by an encoder sensor to put it into a ring buffer in the RAM 4004 at any time. The host 10 is connected with a camera 2040, image information acquired with the camera 2040 is output to the host 10, and image processing is performed with the host 10 to acquire information about the position and shape of the nail in the photographed image and the like.

<Nail Print Processing>

In the nail printing apparatus 20 configured as described above, the start of nail printing is instructed with a hand set printably on the hand placement portion 205 in the hand placement position. Such an instruction may be input from the host 10 or may be input via an operation portion (not shown) provided in the nail printing apparatus 20 or the like. After the start of nail printing is instructed, in the nail printing apparatus 20, the hand placement portion 205 is moved to the print preparation position to start nail print processing to perform printing of the fingernail set on the hand placement portion 205.

Figure 5:
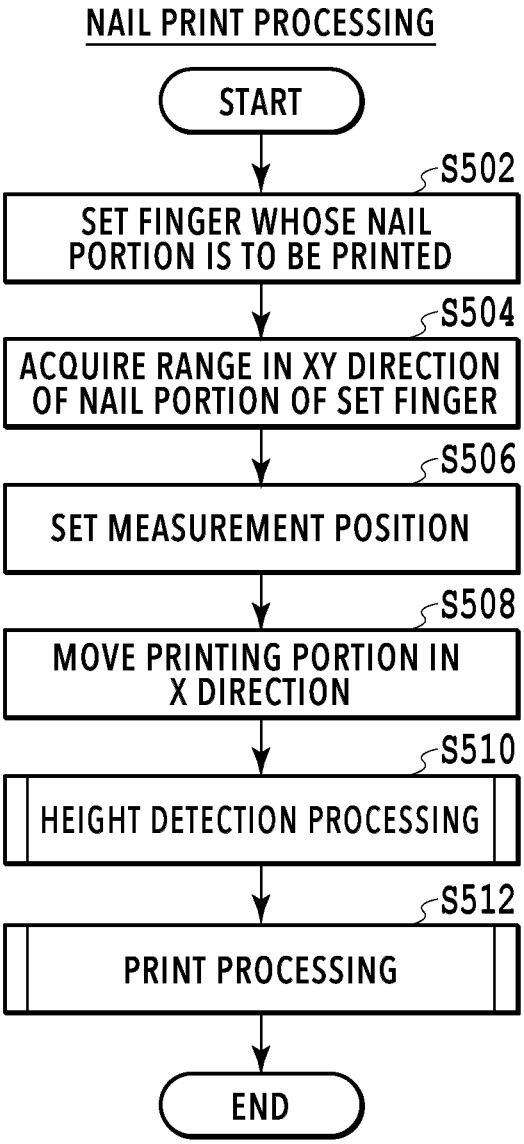
FIG. 5 is a flowchart showing a processing routine of nail print processing.
Figure 6A:
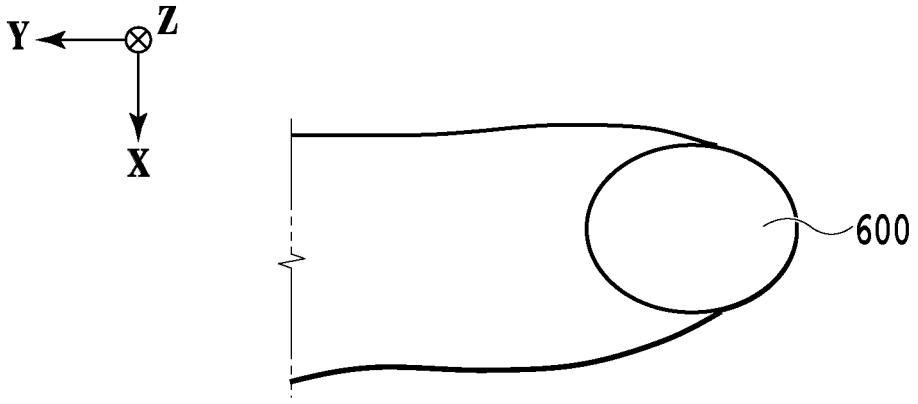
FIGS. 6A and 6B are diagrams showing information on a nail portion to be acquired and a position to measure the information.
Figure 6B:
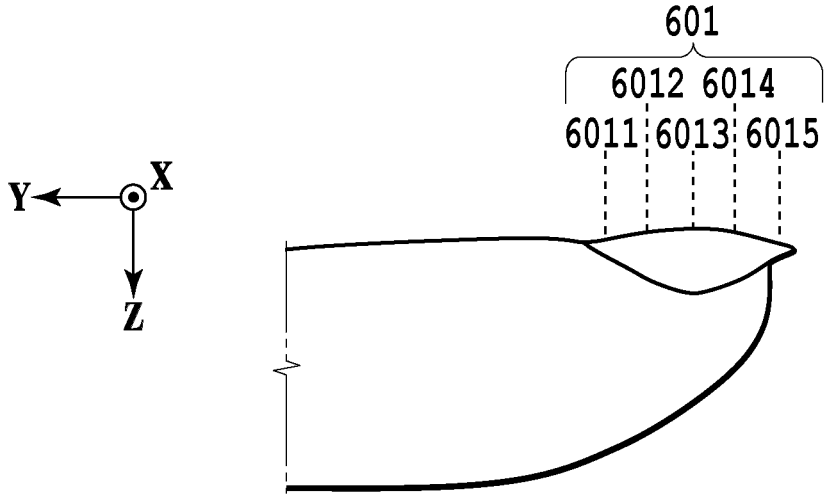
Figure 7:
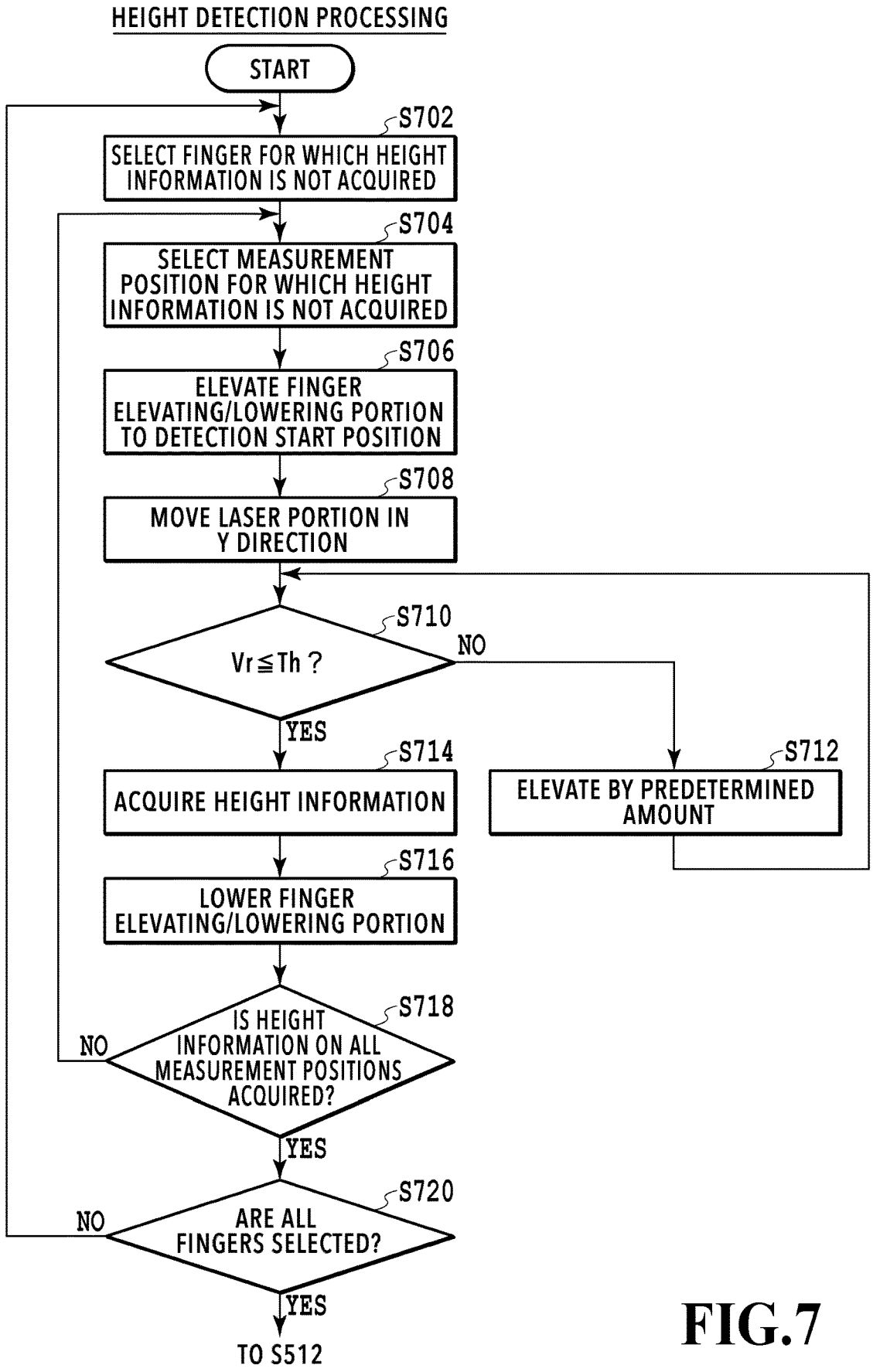
FIG. 7 is a flowchart showing a processing routine of height detection processing which is a subroutine of the processing routine in FIG. 5.
Figure 8:
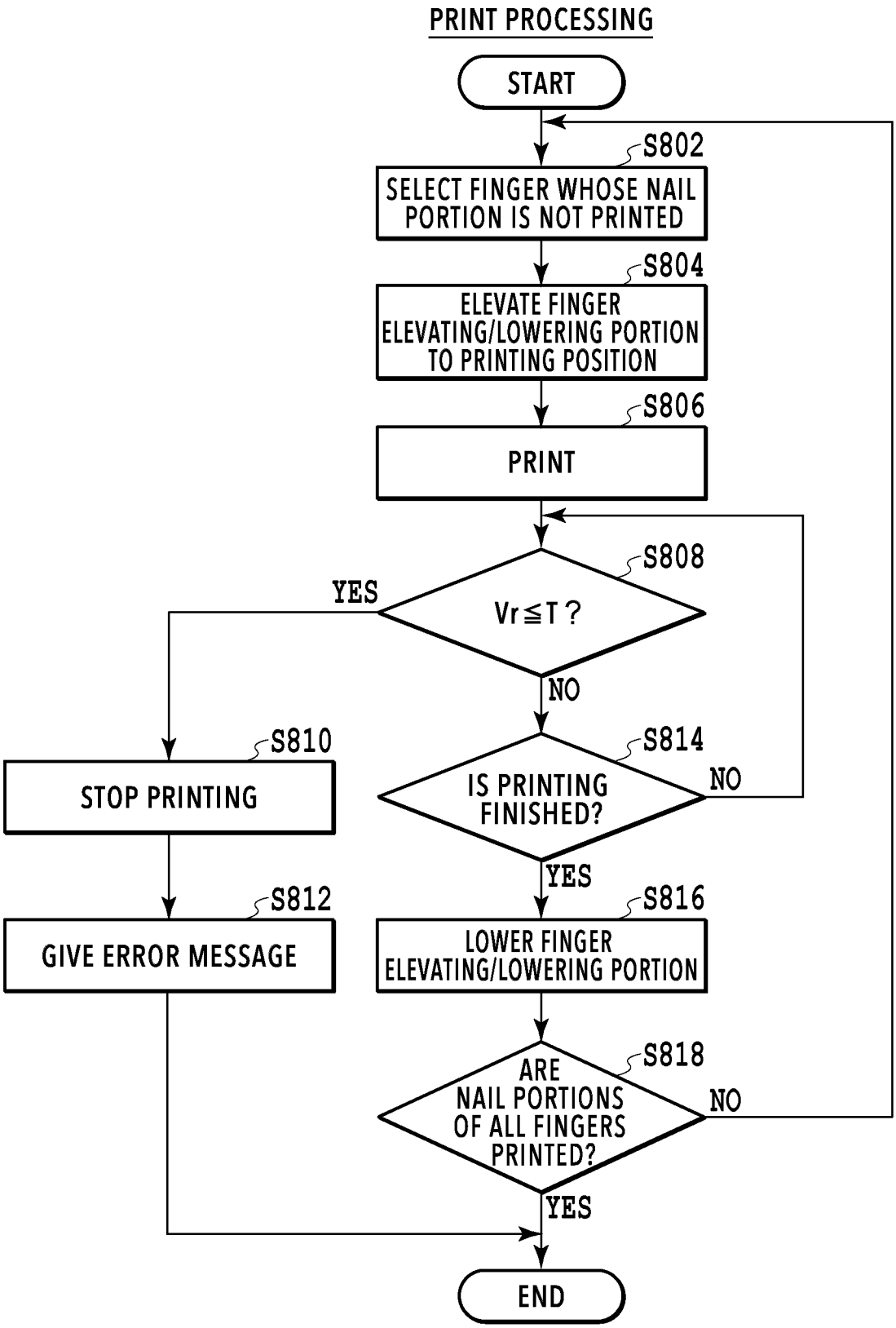
FIG. 8 is a flowchart showing a processing routine of print processing which is a subroutine of the processing routine in FIG. 5.

FIG. 5 is a flowchart showing a detailed processing routine of nail print processing. FIG. 6A is a diagram showing a print range in the XY direction of a nail to be printed which print range is to be acquired. FIG. 6B is a diagram showing an example of a measurement position for measuring the height position of the nail to be printed. FIG. 7 is a diagram showing a detailed processing routine of height detection processing which is a subroutine of the processing routine shown in FIG. 5. FIG. 8 is a diagram showing a detailed processing routine of print processing which is a subroutine of the processing routine shown in FIG. 5.

A series of processes shown in the flowcharts in FIGS. 5, 7, and 8 is performed by the CPU 4001 expanding a program code stored in the ROM 4002 into the RAM 4004 and executing the code. Alternatively, some or all of the functions of the steps in FIGS. 5, 7, and 8 may be executed by hardware such as an ASIC or an electric circuit. The sign S in the description of each process means a step in the flowchart.

In a case where the nail print processing is started, the CPU 4001 first sets a finger whose nail portion is to be printed (S502). In S502, setting is made based on the input to the host 10 by the user. In the host 10, the user designates a finger whose nail portion is to be printed out of fingers placed on the hand placement portion 205 and can set at least one finger, up to a maximum of four fingers. In the host 10, for example, in a case where nail print processing is started, the user is notified to set a finger whose nail is to be printed. Alternatively, the user may be made to make setting in instructing the start of the nail print processing.

After setting a finger whose nail portion is to be printed, the CPU 4001 then photographs the finger placed on the finger elevating/lowering portion 2055 with the camera 2040 to acquire a range 600 (print range) in the XY direction on the nail portion of the finger (S504). For example, in the range 600 in the XY direction on the nail portion of the finger 301, as in FIG. 6A, the shape of the nail portion on an XY plane is acquired as the range 600 in the XY direction. In S504, the shapes on the XY plane of nail portions of all of the fingers set in S502 are acquired. As described above, in the present embodiment, the image information acquired with the camera 2040 is output to the host 10, and the processing in S504 is executed in the host 10, but the present invention is not limited to this. Specifically, the processing in S504 may be executed in the control portion 40 of the nail printing apparatus 20.

Next, based on the range 600 in the XY direction acquired in S504, the CPU 4001 sets a measurement position 601 where the height position (a position in the Z direction) of the nail portion of the finger set in S502 is measured (S506). For example, in the range 600 in the XY direction of the nail portion of the finger 301, as in FIG. 6B, five measurement positions 6011, 6012, 6013, 6014, 6015 are set along the Y direction. The measurement position is not limited to the five points shown in FIG. 6B and may be, for example, one point at the position of the center of gravity on an XY plane shape shown in the range 600 in the XY direction or may be a plurality of points other than the five points. The measurement position may also vary depending on a finger. Further, the measurement position may be measured by predicting the highest point. In S506, measurement positions are set for nail portions of all of the fingers set in S502. The measurement positions to be set are stored in a storage area or the like in advance, and a specific set position is obtained experimentally, for example.

After that, the CPU 4001 moves the printing portion 203 in the X direction to a predetermined position (S508). The predetermined position is a position which does not overlap in the X direction with the finger elevating/lowering portion 2055 on the hand placement portion 205 in the print preparation position. In a case where the printing portion 203 is already located in a predetermined position, S508 is skipped. Next, the CPU 4001 executes height detection processing for acquiring height information on the measurement position set in S506 (S510). In the height detection processing, the optical axis 2062 is used to perform measurement. However, in the processing in S508 immediately before, the printing portion 203 has moved to a position where the printing portion 203 does not overlap the finger elevating/lowering portion 2055 in the X direction. Thus, during the height detection processing, the printing portion 203 is less likely to contact a finger placed on the finger elevating/lowering portion 2055 and the nail portion of the finger.

FIG. 7 shows the detailed processing contents of the height detection processing in S510. In the height detection processing, the optical axis 2062 of laser light by the laser portion 206 is used. Accordingly, in a case where the height detection processing is started, laser light is emitted by the laser portion 206. The laser light may be emitted in a case where the nail print processing is started or in a case where the height detection processing is started as long as the laser light is emitted before the start of the height detection processing.

As shown in FIG. 7, in the height detection processing, the CPU 4001 first selects, out of the fingers set in S502, a finger for which the height information on the measurement position set in S506 is not acquired (S702). Then, the CPU 4001 selects a measurement position for which no height information on the nail portion of the selected finger has been acquired yet (S704).

Next, the CPU 4001 elevates the finger elevating/lowering portion 2055 (specifically, one of the finger elevating/lowering portions 2051 to 2054) on which the finger selected in S702 is placed to a preset detection start position Hk (S706). Up to S704, the finger elevating/lowering portion 2055 is at a lower end within a range in which the portion can be elevated and lowered or in a standby position near the lower end. Thus, in S706, the finger elevating/lowering portion 2055 on which the finger selected in S702 is placed is elevated from the standby position to the detection start position Hk. In a state where a finger is placed on the finger elevating/lowering portion 2055, the detection start position Hk is set so that the nail portion of the finger is below the optical axis 2062 in the Z direction. For example, in a case where the finger 301 is selected in S702, in S706, the finger elevating/lowering portion 2051 on which the finger 301 is placed is elevated to the detection start position Hk set below the optical axis 2062 by a certain amount. The certain amount is set in consideration of the shape of a finger and the shape of a nail portion which vary among individuals and the like.

After that, the laser portion 206 is moved in the Y direction, and the optical axis 2062 is moved to the measurement position (S708). For example, in a case where the measurement position 6011 is set in S506, in S708, the optical axis 2062 is moved in the Y direction to a position that coincides with the measurement position 6011. At this time, since the printing portion 203 is moved to a position where it does not overlap the finger elevating/lowering portion 2055 in the X direction by the processing in S508, the printing portion 203 is prevented from contacting the finger and the nail portion. Further, since the detection start position Hk is set below the optical axis 2062, the nail portion does not block the optical axis 2062 at this point in time. It should be noted that the coincidence between the optical axis 2062 and the measurement position 6011 is not limited to perfect coincidence, but also includes coincidence within a predetermined range.

After the laser portion 206 is moved in the Y direction, it is next determined whether the amount of light received Vr by the light receiving portion 2061 is equal to or less than a threshold value Th (S710). The threshold value Th is a preset value and a value for determining whether the laser light emitted from the light emitting portion 2060 is blocked by the nail portion, that is, whether the nail portion of the finger placed on the finger elevating/lowering portion 2055 reaches the optical axis 2062. In a case where the nail portion reaches the optical axis 2062, the laser light emitted from the light emitting portion 2060 is shaded by the nail portion, and the amount of light received Vr by the light receiving portion 2061 decreases. Therefore, in S710, in a case where "the amount of light received Vr>the threshold Th," it is determined that the nail portion has not reached the optical axis 2062, and in a case where "the amount of light received Vr≤the threshold Th," it is determined that the nail portion has reached the optical axis 2062.

In S710, in a case where it is determined that the amount of light received Vr is not equal to or less than the threshold value Th, it is determined that the nail portion has not reached the optical axis 2062, the CPU 4001 elevates the finger elevating/lowering portion 2055 elevated in S706 by a predetermined amount (S712), and the process returns to S710. This predetermined amount is determined depending on a difference in the Z direction between the detection start position Hk and the optical axis 2062. For example, the predetermined amount is 1/n of the difference (n is a natural number).

In S710, in a case where it is determined that the amount of light received Vr is equal to or less than the threshold value Th, it is determined that the nail portion has reached the optical axis 2062, and the elevation amount of the finger elevating/lowering portion 2055 at this time is acquired as the height information H on the measurement position selected in S704 (S714). In S714, the acquired height information H is, for example, stored in a storage area by associating the finger elevating/lowering portion 2055 with the measurement position. The elevation amount is, for example, the amount of elevation from the standby position to the position where it is determined that the nail portion has reached the optical axis 2062. The elevation amount may be the amount of elevation from the detection start position Hk. Then, the elevated finger elevating/lowering portion 2055 is lowered to the standby position (S716). In S716, the finger elevating/lowering portion 2055 may be lowered to a predetermined position located above the standby position, and the predetermined position may be, for example, the detection start position Hk or a position between the detection start position Hk and the standby position.

Then, it is determined whether height information H on all the measurement positions set for the nail portion of the finger selected in S702 is acquired (S718). In a case where it is determined in S718 that height information H on all the measurement positions is not acquired, the process returns to S704. Alternatively, in a case where it is determined in S718 that height information H on all the measurement positions is acquired, it is determined whether height information H on the measurement positions of the nail portions is acquired for all of the fingers set in S502 (S720). In a case where it is determined in S720 that height information H on the nail portions of all of the fingers set in S502 has not been acquired yet, the process returns to S702. Alternatively, in S720, in a case where it is determined that height information is acquired for the nail portions of all of the fingers set in S502, the process proceeds to S512 described later. At this time, in a case where the finger elevating/lowering portion 2055 is not in the standby position, the finger elevating/lowering portion 2055 is lowered to the standby position.

Referring to FIG. 5 again, after the height detection processing in S510 is finished, the CPU 4001 then executes print processing for performing printing of each nail portion after moving the printing portion 203 to the print start position (S512). The print start position is a preset position and is, for example, a position where the printing portion 203 does not overlap the finger elevating/lowering portions 2051 to 2054 in the X direction and the Y direction. FIG. 8 shows the detailed processing contents of the print processing in S512.

As shown in FIG. 8, in the print processing, the CPU 4001 first selects a finger whose nail portion has not been printed yet (S802). The finger selected in S802 is selected from among the fingers set in S502, and the nail portion of the finger is an object to be printed. In S802, fingers may be selected in order from a finger located on one side in the X direction or may be selected in order from a finger located on the upstream side in the Y direction.

Next, the CPU 4001 elevates the finger elevating/lowering portion 2055 on which the finger selected in S802 is placed to a printing position (S804). For example, in a case where the finger 301 is selected in S802, in S804, the finger elevating/lowering portion 2051 is elevated to the printing position where the printing portion 203 performs printing.

The amount of elevation to the printing position in each finger elevating/lowering portion 2055 is determined based on the height information H acquired by the height detection processing in S510. In a case where a plurality of pieces of height information H are associated with the finger elevating/lowering portion 2055 to be elevated, for example, the finger elevating/lowering portion 2055 is elevated based on an average value of the height information H. The finger elevating/lowering portion 2055 may be elevated based on a maximum value of the height information H, a minimum value of the height information H, or an intermediate value between the maximum value and the minimum value.

Then, the CPU 4001 performs printing based on printing data of the nail portion of the finger selected in S802 (S806). The printing data is data obtained by performing, by the control portion 40, image-processing of the image data input from the host 10 and acquired for each ink which can be ejected from the print head 2030. For example, the printing data is binary data representing ejection and non-ejection of ink from each nozzle.

After printing is started, the CPU 4001 next determines whether the amount of light received Vr by the light receiving portion 2061 is equal to or less than a threshold value T (S808). The threshold value T is a preset value and is a value for determining whether the laser light emitted from the light emitting portion 2060 is shaded by a finger or a nail. In the present embodiment, the threshold value T is set to a value equivalent to the threshold value Th. However, the threshold value T may be, for example, a value smaller than the threshold value Th and may be determined in accordance with the height information H used in determining the amount of elevation to the printing position. The amount of laser light received by the light receiving portion 2061 varies depending on the degree of blockage of the laser light by the nail portion or the like. Thus, for example, in a case where the finger elevating/lowering portion 2055 is elevated based on the maximum value of the height information, the threshold value T is made less than the threshold value Th, so that in S808, the nail portion is detected in a position higher than a height position corresponding to the maximum value.

In S808, in a case where it is determined that the amount of received light Vr is equal to or less than the threshold value T, it is determined that there is a possibility that the printing portion 203 may contact the finger or the nail portion, and the CPU 4001 stops printing (S810) and gives an error message (S812). Then, the print processing is finished, and the nail print processing is finished. The error message may be, for example, one notifying the user of a reason for the stoppage of printing. Further, the error message may be output to the host 10 or may be displayed on a display portion (not shown) provided in the nail printing apparatus 20.

In S808, in a case where it is determined that the amount of received light Vr is not equal to or less than the threshold value T, the CPU 4001 determines whether the printing is finished (S814), and in a case where it is determined that the printing is not finished, the process returns to S808. That is, in the print processing, whenever printing on the nail portion is started in S806, the received amount Vr is always monitored to determine whether the amount of received light Vr is equal to or less than the threshold value T. This prevents contact between the printing portion 203 and the finger and the nail portion while printing is being performed. In a case where it is determined in S816 that the printing is finished, the CPU 4001 lowers the finger elevating/lowering portion 2055 on which the finger having the printed nail portion is placed to the standby position (S816).

Then, the CPU 4001 determines whether nail portions of all of the fingers set in S502 have been printed (S818). In S818, in a case where it is determined that nail portions of all of the fingers set in S502 have not been printed, the process returns to S802. Alternatively, in S818, in a case where it is determined that nail portions of all of the fingers set in S502 have been printed, the CPU 4001 finishes the print processing and finishes the nail print processing. In finishing the nail print processing, the emission of laser light from the light emitting portion 2060 is stopped by the control of the control portion 40.

As described above, in the nail printing apparatus 20 according to the present embodiment, the finger elevating/lowering portion 2055 can elevate and lower a finger whose nail portion is to be printed. Below the lower end (the lowermost portion) of the printing portion 203, the optical axis 2062 by the laser portion 206 is formed in a position separated from a surface on which the nozzle rows 2032 to 2034 for ejecting ink are formed by a distance equal to or less than the distance suitable for printing. Then, before actually performing printing, the laser portion 206 is used to acquire the elevation amount of the finger elevating/lowering portion 2055, and the nail portion to be printed is elevated to the printing position by the finger elevating/lowering portion 2055 based on the elevation amount.

As a result, in the nail printing apparatus 20 of the present embodiment, the height position of the nail portion to be printed can be properly detected. Thus, the nail portion can be moved to the printing position by an elevation amount depending on the shapes of the finger having the nail portion to be printed and the nail, and the nail portion can be moved to a position suitable for printing regardless of variations in the shape of a finger or a nail among individuals. Therefore, it is possible to reduce a deterioration in print quality in the printing on the nail portion. Since noncontact laser light is used to detect the nail portion, there is no risk of damaging the nail portion.

In addition, in the nail printing apparatus 20 according to the present embodiment, it is possible to detect the heights of a plurality of positions of nails, so that the heights of the respective nails can be detected in more suitable positions, and the nail portion can be moved more accurately. Thus, the quality of printing by the printing portion 203 can be improved.

Second Embodiment

Next, a description will be given of a nail printing apparatus according to a second embodiment with reference to FIGS. 9 to 12C. In the following description, the detailed description of features identical or equivalent to those in the first embodiment described above will be omitted by using the same reference numerals as those used in the first embodiment.

The second embodiment is different from the first embodiment in that the elevation amount of the finger elevating/lowering portion 2055 is corrected depending on the inclination of the optical axis 2062 by the laser portion 206.

More specifically, in arranging the laser portion 206, the optical axis 2062 may be inclined due to a mounting tolerance or the like. In a case where the optical axis 2062 is inclined in the Z direction, that is, inclined in the Z direction with respect to the XY plane, in a printing position where the finger elevating/lowering portion 2055 is elevated by an elevation amount based on height information H, a distance between the nail portion and the printing portion 203 may not correspond to a distance suitable for printing.

Then, in the present embodiment, a distance between the optical axis 2062 and the printing portion 203 in a position corresponding to each of the finger elevating/lowering portions 2051 to 2054 is measured at a predetermined timing such as the time of a shipment from a factory, and based on the result of the measurement, the amount of elevation of the finger elevating/lowering portion 2055 to the printing position is corrected.

Figure 9:
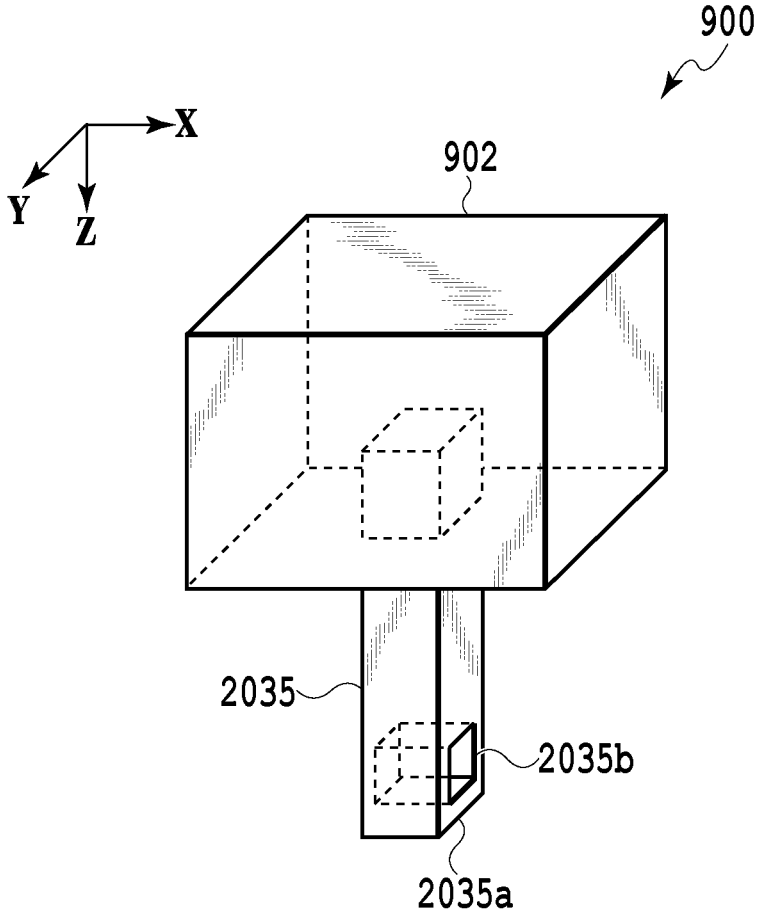
FIG. 9 is a schematic configuration diagram of a measurement portion.
Figure 10A:
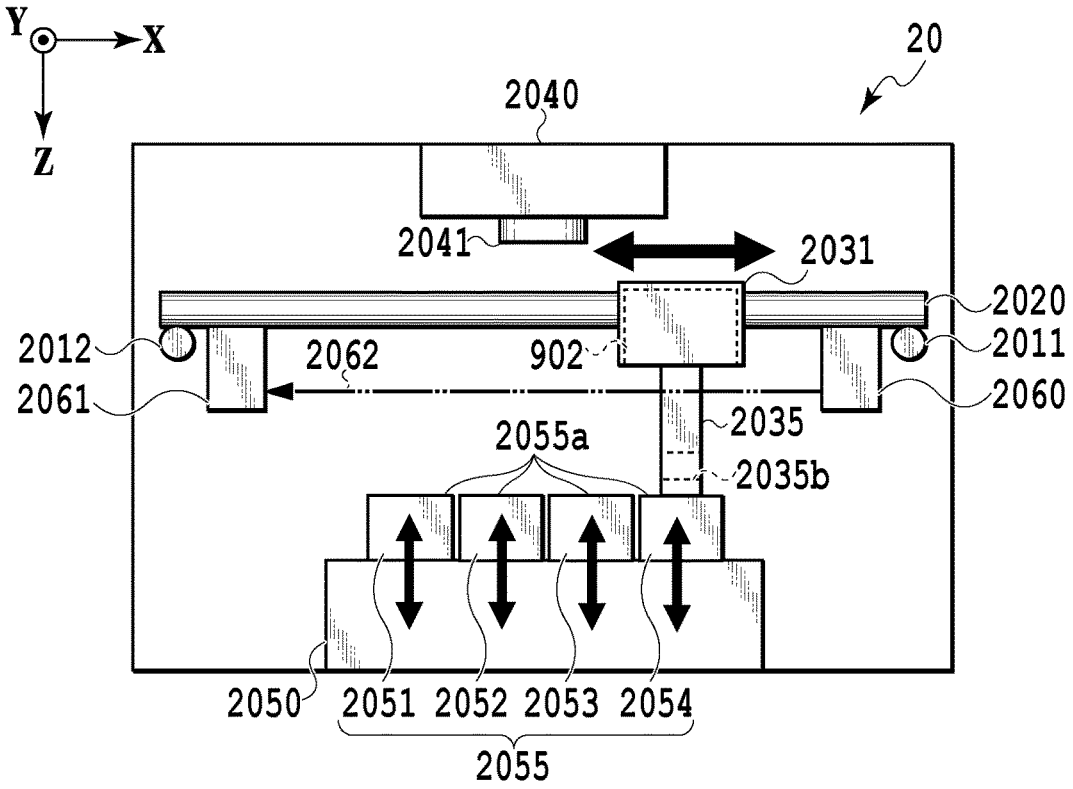
FIGS. 10A and 10B are diagrams showing the position of the measurement portion at the time of measurement.
Figure 10B:
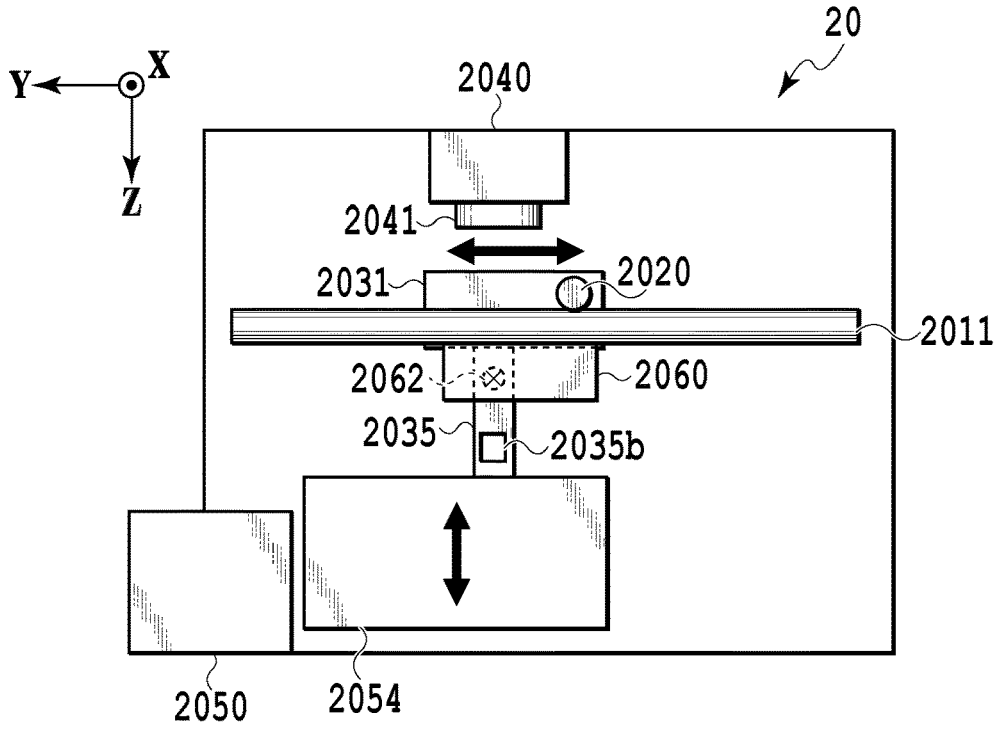

FIG. 9 is a schematic configuration diagram of a measurement portion capable of measuring a distance between the optical axis and the printing portion. FIGS. 10A and 10B are diagrams showing a state where the measurement portion is mounted on a carriage and a tip portion abuts the finger elevating/lowering portion. FIG. 10A is a front view, and FIG. 10B is a right side view.

A measurement portion 900 in FIG. 9 includes a body portion 902 and a movable member 2035 provided movably with respect to the body portion 902. In the present embodiment, the movable member 2035 hangs down from the body portion 902 under its own weight and is elevated by an upward force. The movable member 2035 is made of a material that shades laser light emitted by the laser portion 206, and a transmission portion 2035*b* that allows the laser light to pass through is formed near a tip portion 2035*a*. The transmission portion 2035*b* may be formed of a material that allows laser light from the laser portion 206 to pass through or may be simply formed by making an opening.

The measurement portion 900 is detachably attachable to the carriage 2031. In the case of being mounted on the carriage 2031, the movable member 2035 is movable in a vertical direction, that is, in the Z direction. In a state where the measurement portion 900 is mounted on the carriage 2031, the tip portion 2035*a* of the hanging movable member 2035, in the Z direction, coincides with the surface 2055*a* on which a finger on the finger elevating/lowering portion 2055 in the standby position is placed, or is located below the surface 2055*a* by a certain amount. Additionally, in a state where the measurement portion 900 is mounted on the carriage 2031, the hanging movable member 2035 overlaps the optical axis 2062 (see FIG. 10B). Further, in the measurement portion 900, in a case where the tip portion 2035*a* abuts the surface 2055*a* on which the finger on the finger elevating/lowering portion 2055 in the standby position is placed, the transmission portion 2035*b* is located below the optical axis 2062 (see FIGS. 10A and 10B).

In the main body 902, it is possible to acquire an elevation amount in a case where the movable member 2035 of which tip portion 2035*a* abuts the surface 2055*a* of the finger elevating/lowering portion 2055 is elevated by the finger elevating/lowering portion 2055. The acquired elevation amount is, for example, output to the control portion 40, and a correction value is calculated as described later. The measurement portion 900 of the present embodiment is detachably attachable to the carriage 2031 on which the print head 2030 is not mounted but may be detachably attachable to the carriage 2031 on which the print head 2030 is mounted.

Figure 11:
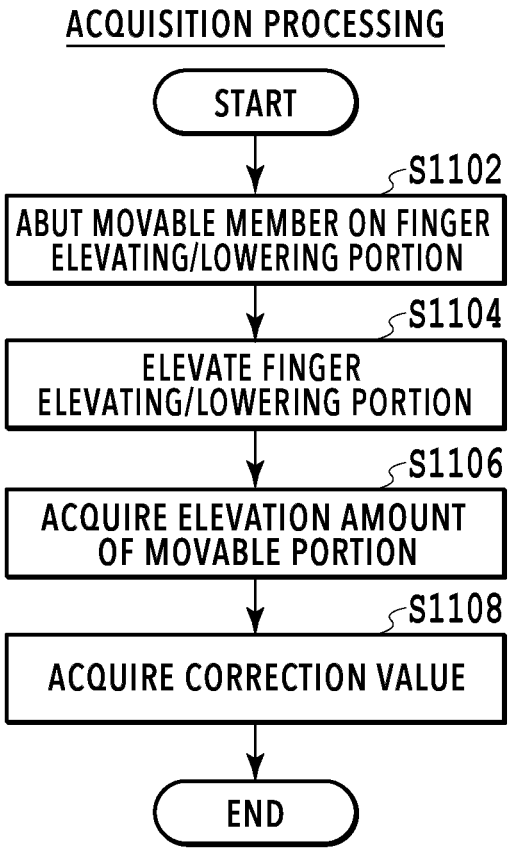
FIG. 11 is a flowchart showing a processing procedure of acquisition processing.
Figure 12A:
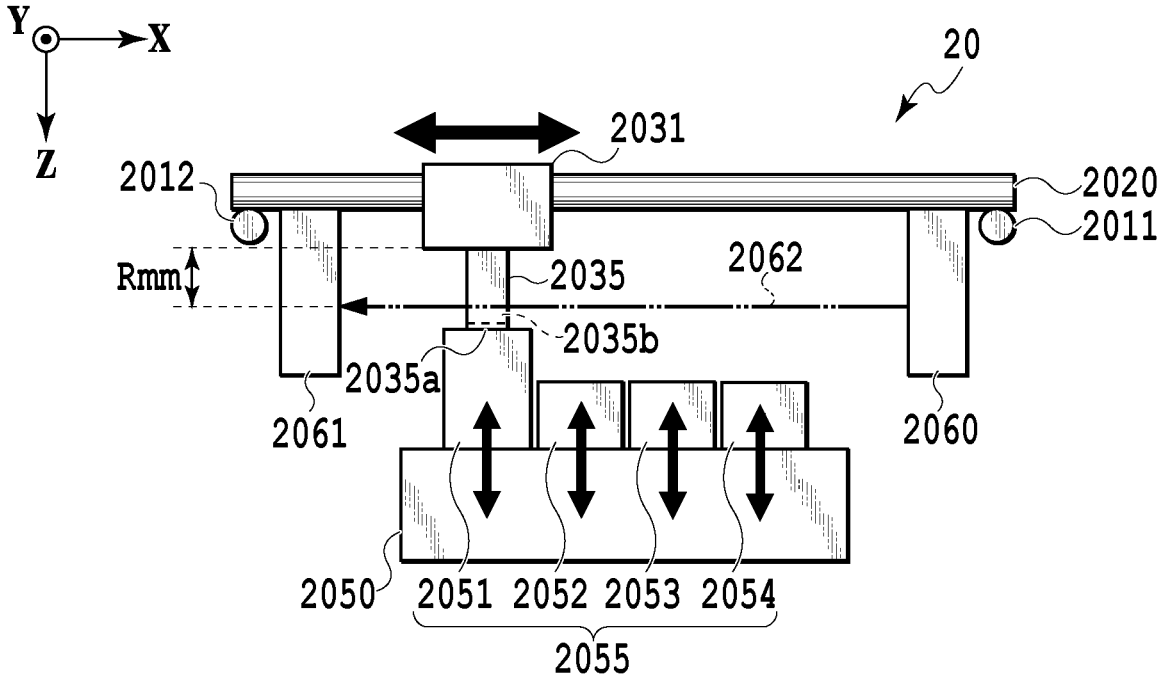
FIGS. 12A and 12B are diagrams showing the measurement portion in a case where an optical axis is inclined.
Figure 12B:
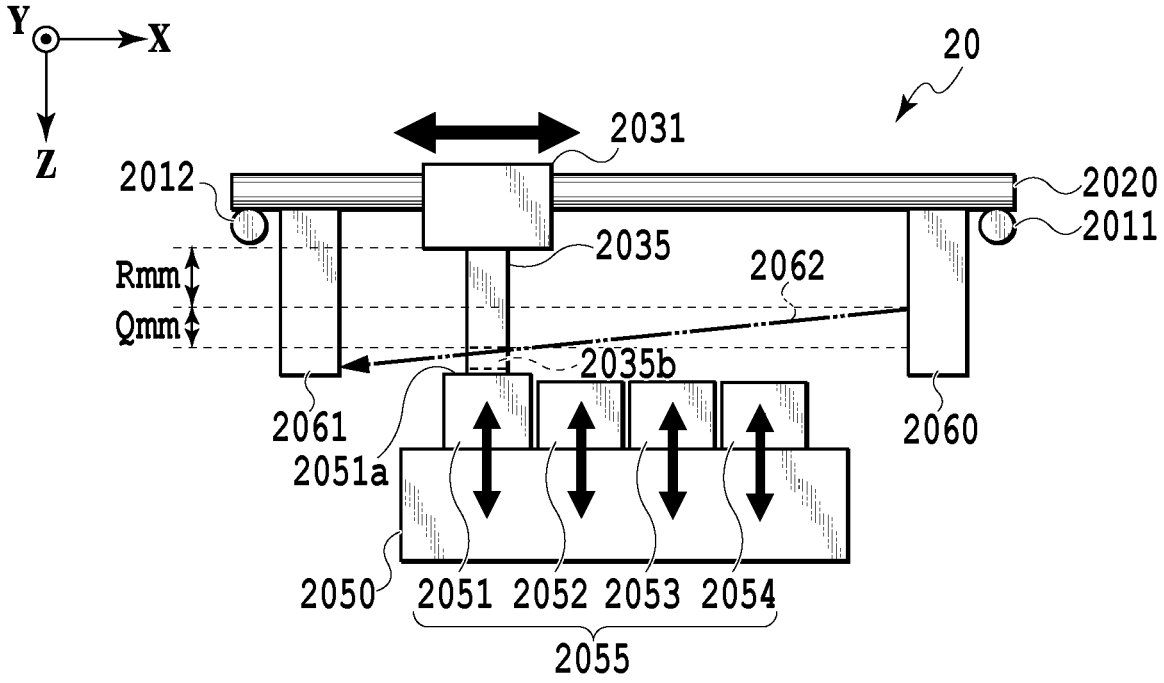

In the above configuration, a correction value for correcting height information H depending on the inclination of the optical axis 2062 due to a mounting tolerance or the like is acquired. Incidentally, the same processing is performed to acquire a correction value for each of the finger elevating/lowering portions 2051 to 2054. Thus, in the following description, as an example, a description will be given of the case of acquiring a correction value in the finger elevating/lowering portion 2051. FIG. 11 is a flowchart showing the procedure of acquisition processing for acquiring a correction value, and FIG. 12A is a diagram showing the state of detecting the optical axis in a case where the optical axis is not inclined. FIG. 12B is a diagram showing the state of detecting the optical axis in a case where the optical axis is inclined.

In acquiring the correction value, as shown in FIGS. 10A and 10B, first, the measurement portion 900 is mounted on the carriage 2031 and the tip portion 2035*a* of the movable member 2035 is made to abut the surface 2051*a* on which the finger is placed in the finger elevating/lowering portion 2051 in the standby position (S1102). At this time, laser light is emitted from the laser portion 206. Then, the elevation of the finger elevating/lowering portion 2051 in the standby position is started (S1104).

Next, the elevation amount of the movable member 2035 in a case where the amount of light received by the light receiving portion 2061 of the laser portion 206 is larger than the predetermined value T is acquired (S1106). The elevation amount is acquired by the measurement portion 900. In a state where the movable member 2035 abuts the finger elevating/lowering portion 2051 in the standby position, as shown in FIGS. 10A and 10B, the optical axis 2062 is blocked by the movable member 2035, and the amount of light received by the light receiving portion 2061 is small. As the finger elevating/lowering portion 2051 is elevated or lowered, the relative position of the optical axis 2062 with respect to the movable member 2035 changes, and the optical axis 2062 reaches the transmission portion 2035*b*. In a case where the optical axis 2062 reaches the transmission portion 2035*b*, the laser light that has passed through the transmission portion 2035*b* is received by the light receiving portion 2061, and the amount of received light increases. Thus, as described above, in S1106, the amount of elevation of the movable member 2035 from a position before the finger elevating/lowering portion 2051 is elevated to a position where the finger elevating/lowering portion 2051 is elevated and the optical axis 2062 reaches the transmission portion 2035*b* is acquired.

After that, the acquired elevation amount is output to the control portion 40, a correction value is acquired by the control portion 40 (S1108), the acquired correction value is associated with the finger elevating/lowering portion 2051 and is stored in a storage area of the control portion 40, and the acquisition processing ends. In the control portion 40, a first distance from a surface on which the nozzle rows 2032 to 2034 in the printing portion 203 are formed to the surface 2055*a* of the finger elevating/lowering portion 2055 in the standby position and the distance suitable for printing of an object to be printed by the printing portion 203 are held. Thus, in the control portion 40, a distance from the surface on which the nozzle rows 2032 to 2034 are formed to the optical axis 2062 is calculated based on the first distance and the elevation amount acquired in S1106. Then, a difference between the calculated distance and the distance suitable for printing described above is acquired as a correction value.

Here, the optical axis 2062 is formed so that the distance between the print head 2030 and the surface on which the nozzle rows 2032 to 2034 are formed coincides with the distance R mm suitable for printing described above. Thus, in a case where the optical axis 2062 is not inclined, as in FIG. 12A, the correction value calculated in S1108 is "0." On the other hand, in a case where the optical axis 2062 is inclined, as in FIG. 12A, the correction value calculated in S1108 is a value changed depending on a position in the X direction. Specifically, in the finger elevating/lowering portion 2055, the correction value becomes larger as the distance from the light emitting portion 2060 increases. In the finger elevating/lowering portion 2051, in a case where the distance between the surface on which the nozzle rows 2032 to 2034 are formed and the optical axis 2062 is larger than the distance suitable for printing by Q mm, the correction value is Q mm upward, for example, +Q mm (see FIG. 12B).

In the present embodiment, in the processing in S804 in print processing, the finger elevating/lowering portion 2055 is elevated to the printing position based on the correction value stored in association with the finger elevating/lowering portion 2055 to be elevated. Specifically, for example, in the finger elevating/lowering portion 2051, the finger elevating/lowering portion 2051 is first elevated by an elevation amount determined based on the height information H. Then, the correction value stored in association with the finger elevating/lowering portion 2051 is acquired to elevate or lower the finger elevating/lowering portion 2051 by an amount based on the correction value. The movement of the finger elevating/lowering portion 2055 is not limited to one performed in two steps as described above. That is, the elevation amount determined based on the height information H in association with the finger elevating/lowering portion 2055 may be corrected depending on the correction value stored in association with the finger elevating/lowering portion 2055, to elevate the finger elevating/lowering portion 2055 based on the corrected elevation amount.

As described above, in the nail printing apparatus 20 according to the present embodiment, the optical axis 2062 can be detected depending on the position of the finger elevating/lowering portion in the X direction by the measurement portion 900 detachably attachable to the carriage 2031. Depending on the result of the detection, the elevation amount of the finger elevating/lowering portion 2055 at the time of printing is corrected. As a result, even in a case where the optical axis 2062 of the laser light generated by the laser portion 206 is inclined in the Z direction, the nail portion can be located in a position suitable for printing, and deterioration in print quality can be more reliably reduced.

OTHER EMBODIMENTS

Incidentally, the above embodiments may be modified as shown in (1) to (6) below.

(1) In the above embodiments, the amount of elevation of the finger elevating/lowering portion to the printing position as a print condition is determined based on the height information H, but the present invention is not limited to this. That is, the finger elevating/lowering portion 2055 may be elevated based on the amount of elevation to the preset printing position to adjust the timing of ejection of ink from the printing portion 203 as a print condition based on the height information H during the processing in S806. In this case, as the height information H shows a greater height, the nail portion is located below the set printing position by a larger amount, so that ejection timing is advanced. Specific ejection timing in accordance with the height information H can be obtained experimentally, for example. In the above second embodiment, after the finger elevating/lowering portion 2055 is elevated based on the amount of elevation to the preset printing position, the timing of ejection may be adjusted based on a correction value.

Figure 13A:
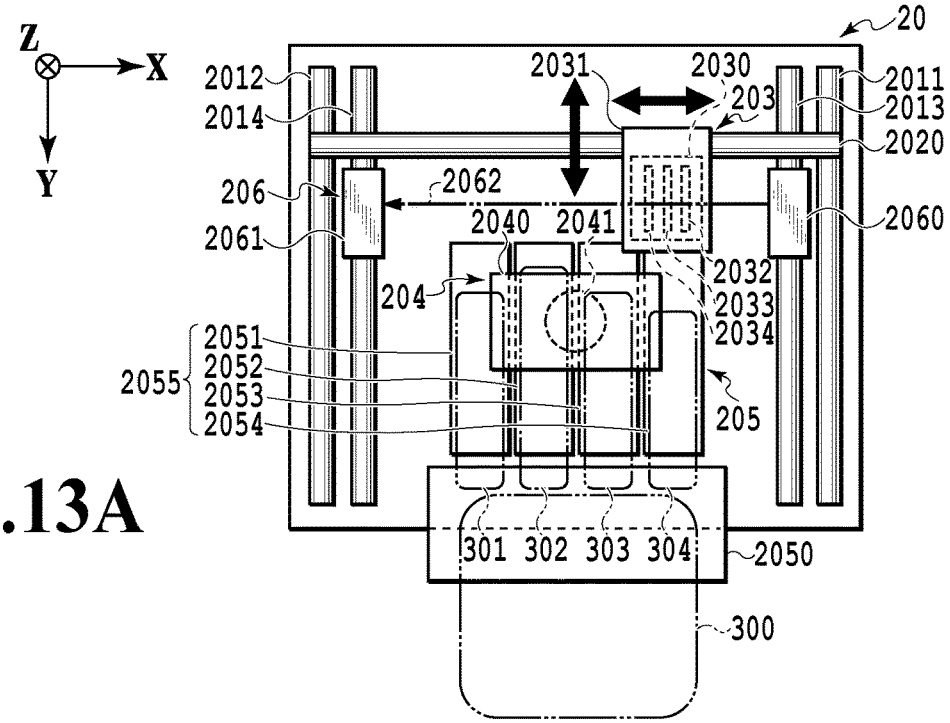
FIGS. 13A to 13C are diagrams showing a modification example of the nail printing apparatus.
Figure 13B:
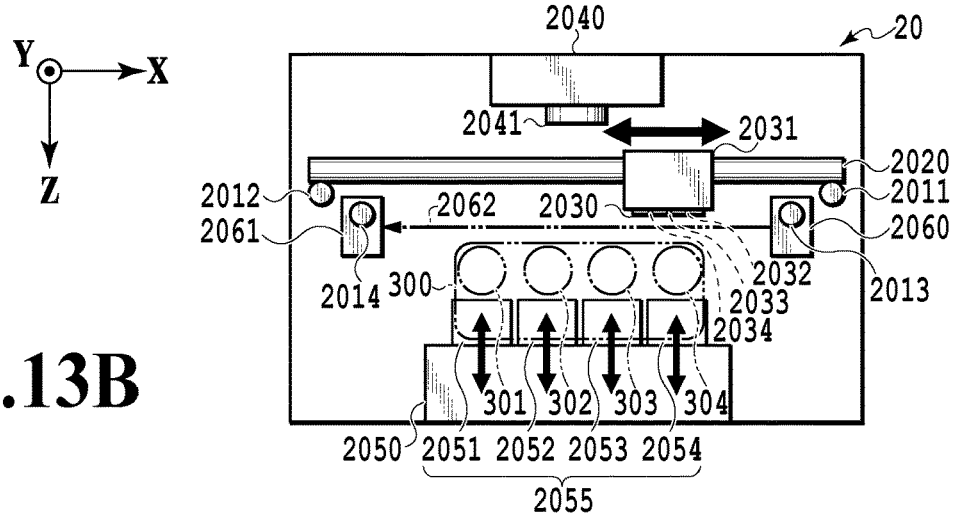
Figure 13C:
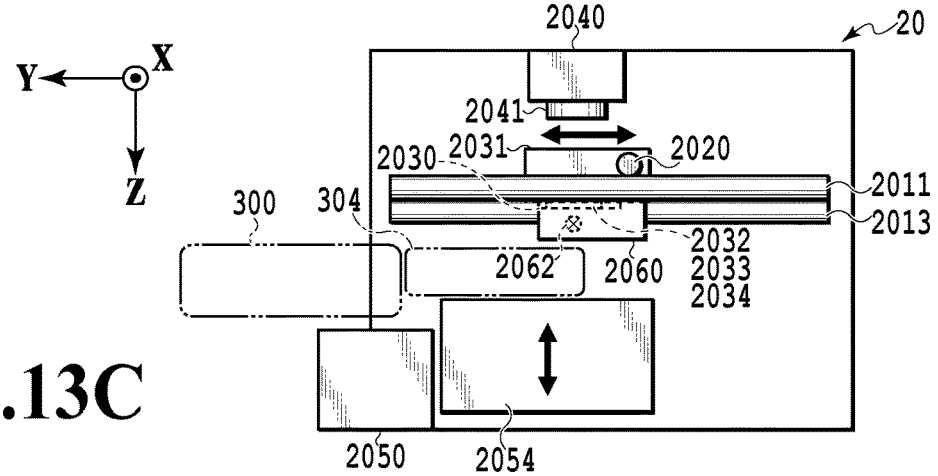

(2) In the above embodiments, the laser portion 206 is fixedly provided on the X rail guide 2020 so as to be movable integrally with the printing portion 203 in the Y direction, but the present invention is not limited to this. For example, the laser portion 206 and the printing portion 203 may be independently movable in the Y direction. FIGS. 13A to 13C are schematic configuration diagrams of a nail printing apparatus in which the laser portion 206 is movable in the Y direction independently of the printing portion 203. FIG. 13A is a plan view, FIG. 13B is a front view, and FIG. 13C is a right side view.

For example, as shown in FIGS. 13A to 13C, the nail printing apparatus 20 includes a pair of Y rail guides 2013 and 2014 extending in the Y direction. The light emitting portion 2060 is movably provided on the one Y rail guide 2013, and the light receiving portion 2061 is movably provided on the other Y rail guide 2014. For example, the movements of the light emitting portion 2060 and the light receiving portion 2061 are controlled by different motors so as to be synchronized with each other. The light emitting portion 2060 and the light receiving portion 2061 are arranged movably in the Y direction in positions where the light emitting portion 2060 and the light receiving portion 2061 do not interfere with the printing portion 203 moving in the X direction and the Y direction.

In this case, in the processing in S508 in the nail print processing, the printing portion 203 is moved not only in the X direction but also in the Y direction. This makes it more difficult for the finger placed on the finger elevating/lowering portion 2055 to contact the printing portion 203 in the processing in S708 in the height detection processing and the like. Thus, the degree of freedom of control of the finger elevating/lowering portion 2055, the laser portion 206, and the like increases.

During print operation by the printing portion 203, the movement of the laser portion 206 is controlled such that the optical axis 2062 overlaps with the nozzle rows 2032 to 2034 in the printing portion 203 in the X direction and the Y direction. Further, the laser portion 206 may be moved to the nail portion to be printed before the processing in S806. This makes it possible to determine whether there is a possibility that the nail portion and the print head 2030 may contact each other before the printing portion 203 actually moves to the nail portion to be printed. As a result, the printing portion 203 can avoid contact with the finger. Additionally, it is possible to more reliably avoid dirt on the finger and the nail portion, damage to the print head 2030, and the like.

In this case, for example, the laser portion 206 may be movable not only in the Y direction but also in the Z direction. In a case where the laser portion 206 is movable in the Z direction independently of the printing portion 203, a distance between the printing portion 203 and the optical axis 2062 may vary between the case of height detection processing and the case of print processing.

(3) In the above second embodiment, the movable member 2035 hangs down under its own weight in the measurement portion 900, but the configuration of the measurement portion 900 is not limited to this. For example, the movable member 2035 may be able to descend manually or automatically from the body portion 902. In this case, a distance between the surface on which the nozzle rows are formed in the printing portion 203 and the optical axis 2062 may be acquired based on a lowering amount in a case where the movable member 2035 is lowered in the state of being mounted on the carriage 2031 and the optical axis reaches the transmission portion 2035*b*.

(4) In the above embodiments, the nail printing apparatus for performing printing based on an inkjet system is described as an example, but the application of the present invention is not limited to this. The above embodiments can be applied to various printing apparatuses in which the position of a print medium with respect to the printing portion can be adjusted. A printing system is not limited to the inkjet system. Various printing systems on which printing is performed at a predetermined interval from an object to be printed can also be applied.

(5) In the above embodiments, the distance between the printing portion 203 and the optical axis 2062 is set to be less than or equal to the distance suitable for printing on the object to be printed by the printing portion 203, but the present invention is not limited to this. The distance between the printing portion 203 and the optical axis 2062 can be set as appropriate, and based on the set predetermined distance, the amount of elevation/lowering of the nail portion by the finger elevating/lowering portion 2055 at the time of printing to achieve the distance suitable for printing with respect to the printing portion 203 may be calculated. Further, in the above embodiments, the laser light is used to detect a finger and a nail portion, but a means for detecting a finger and a nail portion is not limited to this. As the means for detecting a finger and a nail portion, publicly known various techniques can be used as long as a noncontact system is applied.

(6) The various modes shown in the embodiments and (1) to (5) above may be combined as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-053236, filed Mar. 26, 2021, which is hereby incorporated by reference in its entirety.

What is claimed is:

1. A printing apparatus comprising:

a printing unit configured to eject a liquid to an object to be printed in a first direction to perform printing;

a placement unit on which the object is placed;

a detection unit capable of detecting a position of the object in the first direction in a noncontact manner; and a control unit configured to perform a first detection which changes relative positions of the placement unit and the detection unit in the first direction and on a plane intersecting the first direction before the printing on the object to detect, by the detection unit, the object placed on the placement unit, the control unit configured to perform a second detection which changes the relative positions of the placement unit and the detection unit on the plane during the printing on the object to detect, by the detection unit, the object placed on the placement unit.

2. The printing apparatus according to claim 1, wherein the object is printed by the printing unit in a state where the control unit changes a distance between the printing unit and the placement unit in the first direction based on a result of the first detection.

3. The printing apparatus according to claim 2, wherein based on the result of the first detection, the control unit adjusts relative positions of the printing unit and the placement unit so that the distance between the object and the printing unit is a predetermined distance.

4. The printing apparatus according to claim 1, wherein based on a result of the first detection, the control unit adjusts timing of ejection of the liquid to the object by the printing unit.

5. The printing apparatus according to claim 1, wherein the detection unit includes a light emitting portion which forms an optical axis of light and a light receiving portion which receives the light, and the detection unit detects the object based on an amount of light received by the light receiving portion.

6. The printing apparatus according to claim 5, wherein the detection unit moves integrally with the printing unit.

7. The printing apparatus according to claim 6, wherein the printing unit is provided movably along a first guide portion extending in a second direction on the plane, the first guide portion is provided movably along a second guide portion extending in a third direction intersecting the second direction on the plane, and in the detection unit, the light emitting portion and the light receiving portion are provided in the first guide portion in a position out of a movement range of the printing unit in the second direction.

8. The printing apparatus according to claim 5, wherein the detection unit moves independently of the printing unit.

9. The printing apparatus according to claim 8, wherein the printing unit is provided movably along a first guide portion extending in a second direction on the plane, the first guide portion is provided movably along a second guide portion extending in a third direction intersecting the second direction on the plane, and in the detection unit, the light emitting portion and the light receiving portion are provided movably along a third guide portion extending along the third direction so as not to interfere with movements of the printing unit in the second direction and the third direction, respectively.

10. The printing apparatus according to claim 5, further comprising a measurement unit capable of measuring a distance between the printing unit and the optical axis in the first direction, wherein based on a result of measurement with the measurement unit, the control unit acquires a correction value for correcting a distance between the object and the printing unit in the first direction to a predetermined distance.

11. The printing apparatus according to claim 10, wherein based on the correction value, the control unit adjusts relative positions of the printing unit and the placement unit so that the distance between the object and the printing unit is the predetermined distance.

12. The printing apparatus according to claim 10, wherein based on the correction value, the control unit adjusts timing of ejection of the liquid to the object by the printing unit.

13. The printing apparatus according to claim 1, further comprising a photographing unit capable of photographing the object placed on the placement unit, wherein a print range of the object on the plane is acquired based on an image photographed with the photographing unit.

14. The printing apparatus according to claim 13, wherein in the control unit, the first detection detects, based on the print range, at least one point of the object placed on the placement unit.

15. The printing apparatus according to claim 14, wherein in the control unit, the first detection performs detection in a plurality of points along a third direction on the plane.

16. The printing apparatus according to claim 1, wherein the object is a nail.

17. The printing apparatus according to claim 1, wherein the detection unit is separated from the printing unit by a distance equal to or less than a distance suitable for printing on the object by the printing unit in the first direction.

18. A method of controlling a printing apparatus comprising a printing unit configured to eject a liquid to an object to be printed in a first direction to perform printing, a placement unit on which the object is placed, and a detection unit capable of detecting a position of the object in the first direction in a noncontact manner, the method comprising:

changing relative positions of the placement unit and the detection unit in the first direction and on a plane intersecting the first direction before the printing on the object to detect, by the detection unit, the object placed on the placement unit, and changing the relative positions of the placement unit and the detection unit on the plane during the printing on the object to detect, by the detection unit, the object placed on the placement unit.

19. A printing apparatus comprising:

a printing unit configured to eject a liquid to an object to be printed in a first direction to perform printing;

a placement unit on which the object is placed;

a photographing unit configured to photograph the object placed on the placement unit;

a detection unit capable of detecting a position of the object in the first direction in a noncontact manner; and a control unit configured to change relative positions of the placement unit and the detection unit in the first direction and on a plane intersecting the first direction based on an image photographed with the photographing unit, to detect the object placed on the placement unit by the detection unit.

20. The printing apparatus according to claim 19, wherein the control unit acquires a position and a shape of the object on the plane based on an image photographed with the photographing unit and determines a position detected by the detection unit in the object based on acquired information.

* * * * *